US006152763A

United States Patent [19]

Sai

[11] Patent Number: 6,152,763

[45] Date of Patent: Nov. 28, 2000

[54] ELECTRICAL CONTACT FOR TERMINATION TO FLAT CONDUCTIVE MEMBER

[75] Inventor: Noriaki Sai, Kanagawa, Japan

[73] Assignee: The Whitaker Corporation, Wilmington, Del.

[21] Appl. No.: 09/202,115

[22] PCT Filed: Sep. 7, 1997

[86] PCT No.: PCT/US97/15880

§ 371 Date: Mar. 4, 1999

§ 102(e) Date: Mar. 4, 1999

[87] PCT Pub. No.: WO98/11629

PCT Pub. Date: Mar. 19, 1998

[30] Foreign Application Priority Data

Sep. 10, 1996 [JP] Japan ..... 8-261923

[51] Int. Cl.[7] ..... H01R 12/24

[52] U.S. Cl. ..... 439/492; 439/948; 439/835

[58] Field of Search ..... 439/948, 977, 439/866, 492, 495, 535

[56] References Cited

U.S. PATENT DOCUMENTS

| | | | |
|---|---|---|---|
| 2,997,685 | 8/1961 | Anderson . | |
| 3,456,235 | 7/1969 | Kennedy . | |
| 3,696,322 | 10/1972 | Spangler et al. . | |
| 4,371,230 | 2/1983 | Inoue . | |
| 4,952,177 | 8/1990 | Drake et al. | 439/828 |

FOREIGN PATENT DOCUMENTS

| | | | |
|---|---|---|---|
| 4238370 A1 | 5/1994 | Germany | H01R 11/28 |

*Primary Examiner*—Lincoln Donovan
*Assistant Examiner*—Javaid Nasri

[57] ABSTRACT

Electrical contact (1) having a terminating section (20) that terminates a foil-form conductive member (60), and an elastic contact part (30) that elastically contacts the conductive member (60). The elastic contact part (30) has: [a] a spring arm (33) that has an embossment (34) with a substantially spherical surface that presses against the conductive member (60); and [b] a substantially circular hole (38) that faces the embossment (34) of the spring arm (33), and that has a rim that is contacted in a substantially circumferential state of contact by the conductive part (62) of the conductive member (60) pressed by the embossment (34).

15 Claims, 4 Drawing Sheets

ELECTRICAL CONTACT FOR TERMINATION TO FLAT CONDUCTIVE MEMBER

FIELD OF THE INVENTION

The present invention concerns an electrical contact that is used to terminate a flat conductive member formed by disposing foil-form conductive parts on one or both sides of a flat insulating body.

BACKGROUND OF THE INVENTION

For example, the connector shown in FIGS. 7 to 9 (see U.S. Pat. No. 3,247,316) has been known in the past as an electrical connector used to terminate a conductive member consisting of a foil-form metal sheet.

As is shown in FIG. 7, electrical connector 100 has two facing plate parts 101 and 102 that are connected at one end; these plate parts are formed by punching out and bending a metal plate. Teeth 104 and teeth 105 that face the teeth 104 are formed on the upper and lower plate parts 101 and 102 so that the teeth extend toward each other. The teeth 104 and teeth 105 are alternately disposed in two rows on the upper and lower plate parts 101 and 102.

In FIG. 8, a conductive member 110 consisting of a foil-form metal sheet is inserted between the upper and lower plate parts 101,102 of the electrical connector 100. As is shown in FIG. 9, the upper and lower plate parts 101,102 are pressed together, so that teeth 104 pierce the conductive member 110, and so that teeth 105 pass through the conductive member, thus terminating the conductive member 110 in the electrical connector 100. Teeth 105 of each plate part also pass through holes 106 defined through the other plate part at teeth 104 thereof, whereafter ends of teeth 105 are flattened and are bent over portions of the conductor member also extruded through holes 106. In FIGS. 7 to 9, 103 indicates an electrical wire connecting part that is used for a crimped connection of an electrical wire 120.

However, in this conventional electrical connector 100, when the conductive member 110 is terminated in the electrical connector 100 and teeth 104 are caused to pierce the conductive member 110, and teeth 105 are caused to pass through the conductive member, the following problem arises: i.e., the connecting portions of the conductive member 110 that connect with the teeth 104 and 105 are structurally weak, so that contact of the electrical connector 100 with the conductive member 110 is unstable.

SUMMARY OF THE INVENTION

In U.S. Pat. No. 4,952,177 is disclosed a clamp for an electrosurgical electrode in which one or two U-shaped electrical contact strips engage tab electrodes and are contained in a housing, with upper strip portions becoming pressed firmly against the electrodes upon pivoting of a lever to cam the upper strips toward the electrodes for embossments on the upper strips to press the electrodes against depressions in the lower portions of the strips, for electrical connection.

Accordingly, the object of the present invention is to provide an electrical contact that insures stable contact with a conductive member formed by disposing foil-form conductive parts on one or both sides of a flat insulating body, when such a conductive member is terminated.

The electrical contact of the present invention has a terminating section that terminates a flat conductive member formed by disposing a foil-form conductive part on one or both sides of a flat insulating body, and an elastic contact part that elastically contacts the conductive member. The electrical contact is characterized by the fact that the elastic contact part has [a] a string arm that has an embossment with a substantially spherical surface that presses against the conductive member, and [b] a substantially circular hole that faces the embossment, and that has a rim that is contacted in a substantially circumferential state of contact by the conductive part of the conductive member pressed by the embossment. A free end of the spring arm includes anchoring portions that lock with side walls of the base when pressed downwardly.

DETAILED DESCRIPTION

Preferably, the electrical contact of the present invention may also be constructed so that the contact has a terminating section that terminates a flat conductive member formed by disposing foil-form conductive parts on one or both sides of a flat insulating body, and an elastic contact part that elastically contacts the conductive member, and so that the elastic contact part has: [a] a spring arm that has an embossment with a substantially spherical surface that presses against the conductive member, [b] a substantially circular hole that faces the embossment of the spring arm, and that has a rim that is contacted in a substantially circumferential state of contact by the conductive part of the conductive member pressed by the embossment, and [c] a stopper for the spring arm that maintains the pressing state of the spring arm that is accomplished via the embossment. If such a construction is used, the pressing state of the spring arm that is accomplished via the embossment will be maintained when the conductive part of the conductive member is caused to contact the substantially circular hole, so that the contact of the electrical contact with the conductive member is even more stable.

BRIEF DESCRIPTION OF THE DRAWINGS

An embodiment of the present invention will now be described by way of example with reference to the accompanying drawings.

DETAILED DESCRIPTION

Figure 1:
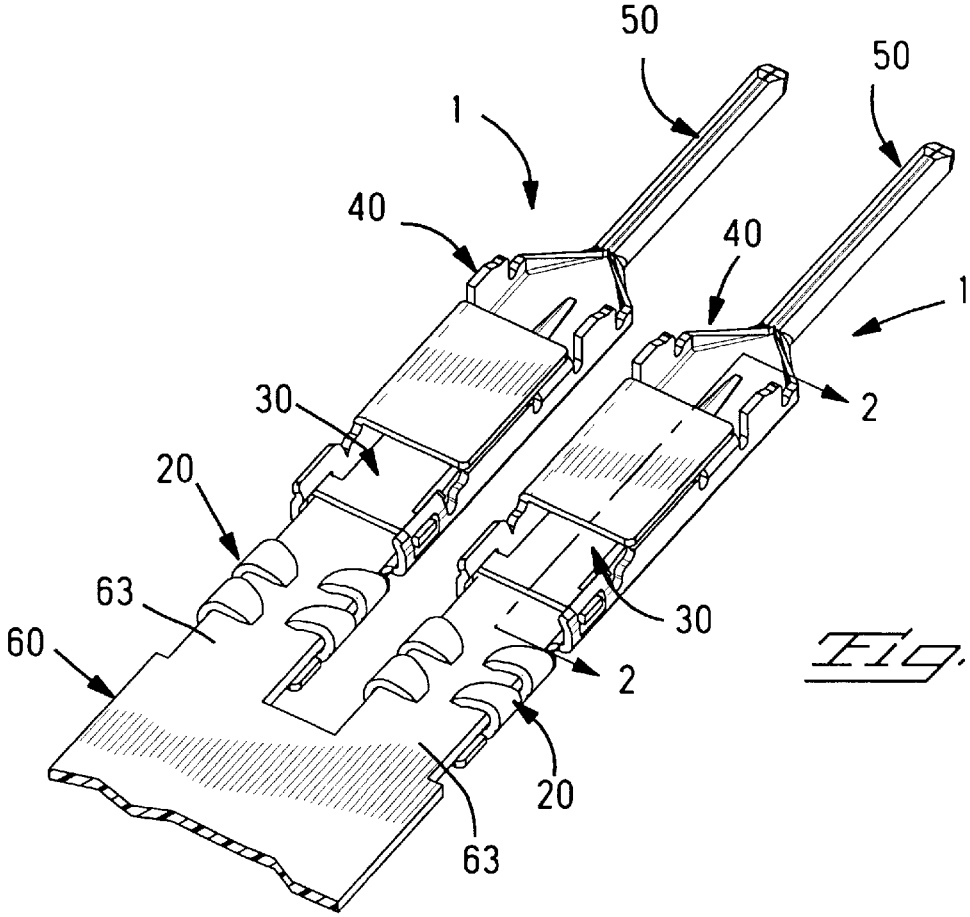
FIG. 1 is an isometric view of a conductive member terminated in electrical contacts of the present invention.

In FIGS. 1 to 6, electrical contact 1 has a terminating section 20 that terminates a flat conductive member 60 that has a foil-form conductive part 62 on one or both sides, an elastic contact part 30 that makes elastic contact with the conductive member 60, a housing fastening part 40 that is fastened by press fitting in an insulating housing (not shown in the figures), and a mating terminal contact part 50 that contacts a mating terminal (also not shown). These parts are formed by punching out and bending a metal plate.

Figure 4:
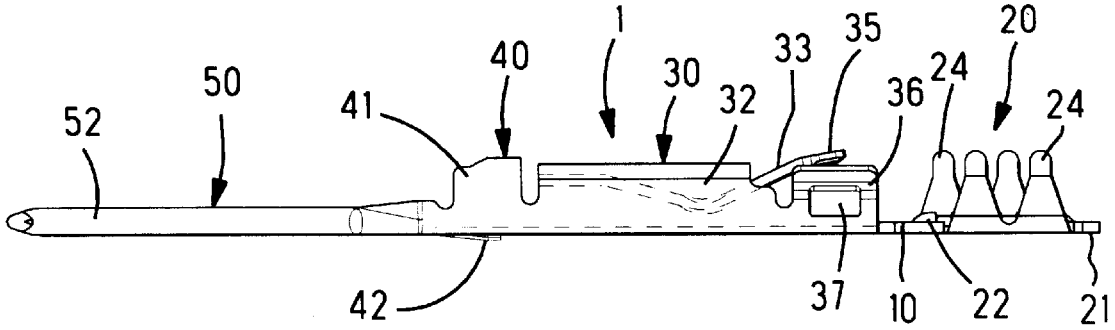
Figure 5:
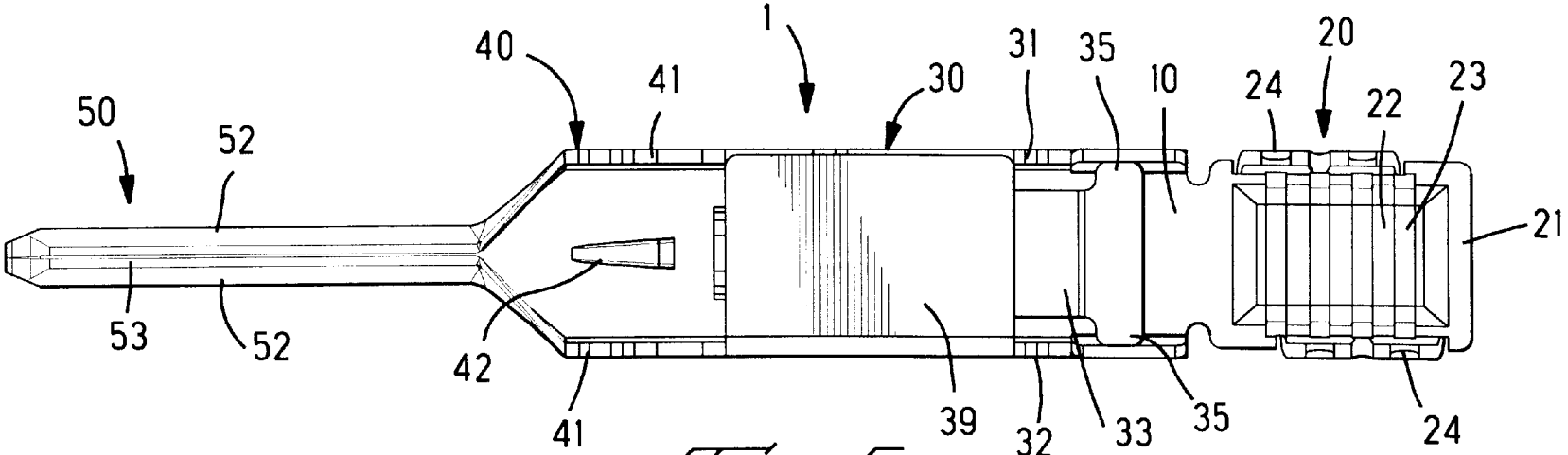
Figure 6:
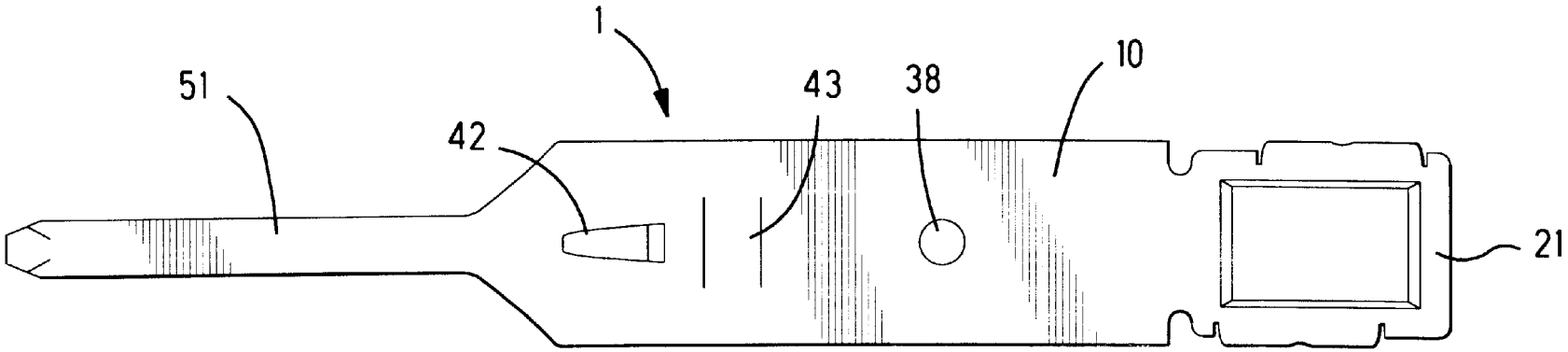
Figure 7:
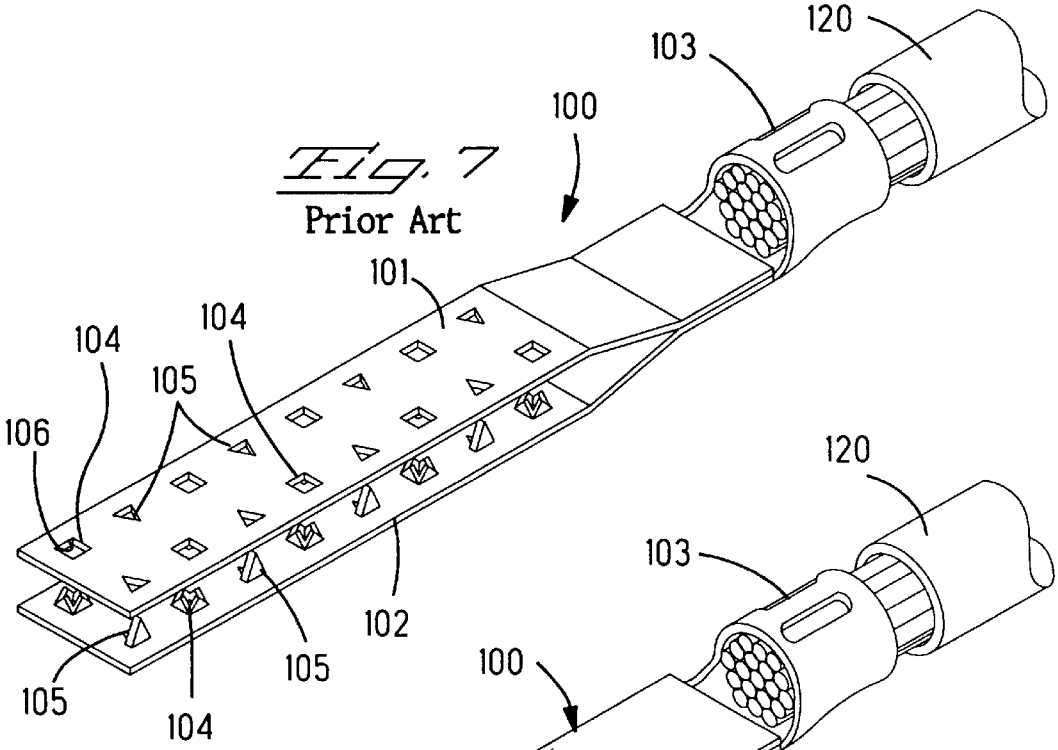
Fig. 7 Prior Art
FIGS. 7 to 9 illustrates a conventional electrical connector, with FIG. 9 being a sectional view along lines 9—9 of FIG. 8.
Figure 8:
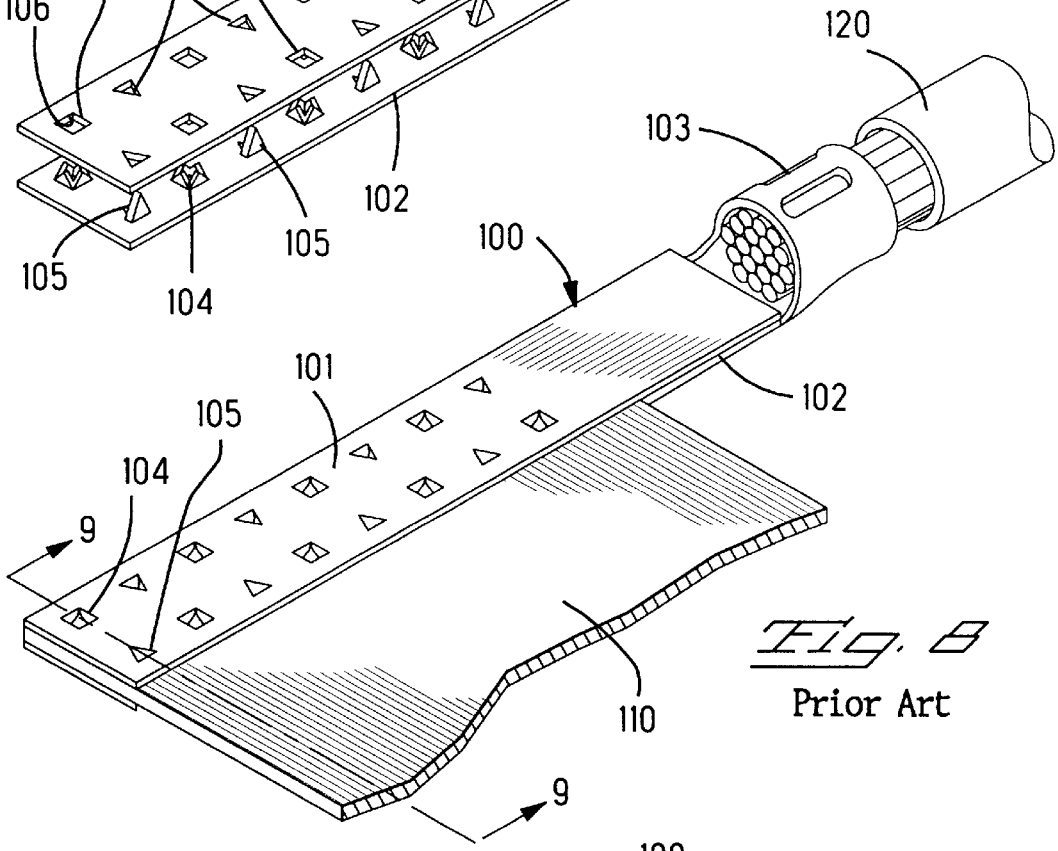
Fig. 8 Prior Art
Figure 9:
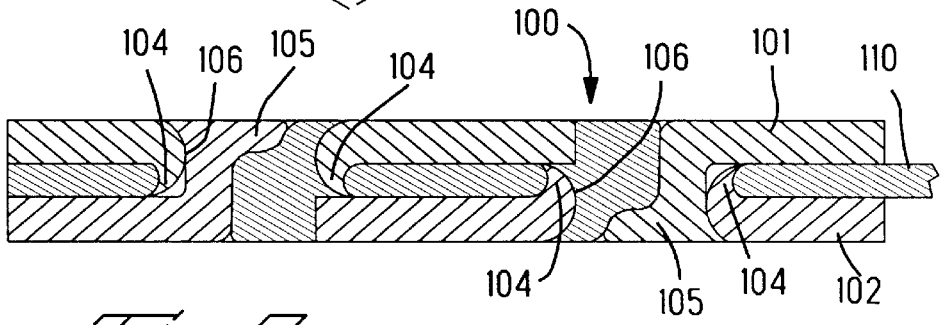
Fig. 9 Prior Art

The terminating section 20 has a base section 21 that extends from the rear end (i.e., the right end in FIG. 4 of a contact base 10, a projecting part 22 that protrudes from the surface of the base section 21, a plurality of grooves 23 that are formed in the surface of the projecting part 22 at a specified spacing, and a plurality of pairs of crimping arms 24 that rise from both sides of the base section 21, and that are used for attachment of the conductive member 60 by crimping. Here, the terminating section 20 is described as a part that fastens the conductive member 60 in place by crimping; however, the terminating section 21 could also be a part that pierces the conductive member 60.

The elastic contact part 30 has a pair of side walls 31 and 32 that rise from both sides of the contact base 10, and a spring arm 33 that is bent inward from one 31 of the side walls and extends to a free end at the rear of the contact base 10. In a free state, the elastic contact part 33 has a substantially V-shaped cross section extending from the front of the contact base 10 to the rear of the contact base 10. An embossment 34 is formed by punching in the approximate axial center of the spring arm 33, with a substantially spherical surface that presses against the conductive member 60 terminated in the terminating section 20.

A substantially circular hole 38 is formed in the contact base 10 in a position facing the embossment 34 of the spring arm 33. This substantially circular hole 38 has a rim that is contacted in a substantially circumferential state of contact by the conductive part 62 of the conductive member 60 that is pressed by the embossment 34. Furthermore, a pair of latching walls 36,36 for the spring arm 33 are caused to rise from both sides of the contact base 10 to the rear of side walls 31,32, and latching walls 36,36 have respective openings 37.

Figure 2:
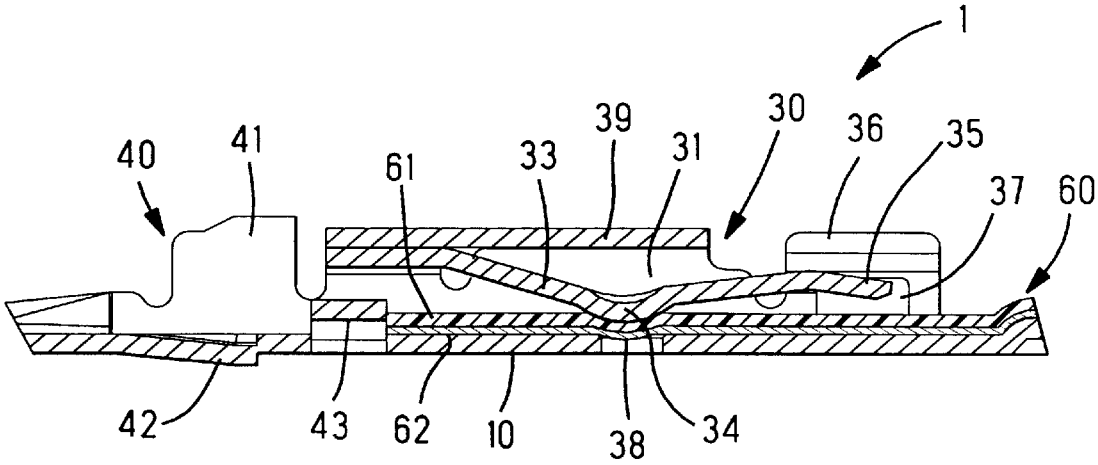
FIG. 2 is a partial enlarged sectional view along lines 2—2 of FIG. 1.
Figure 3:
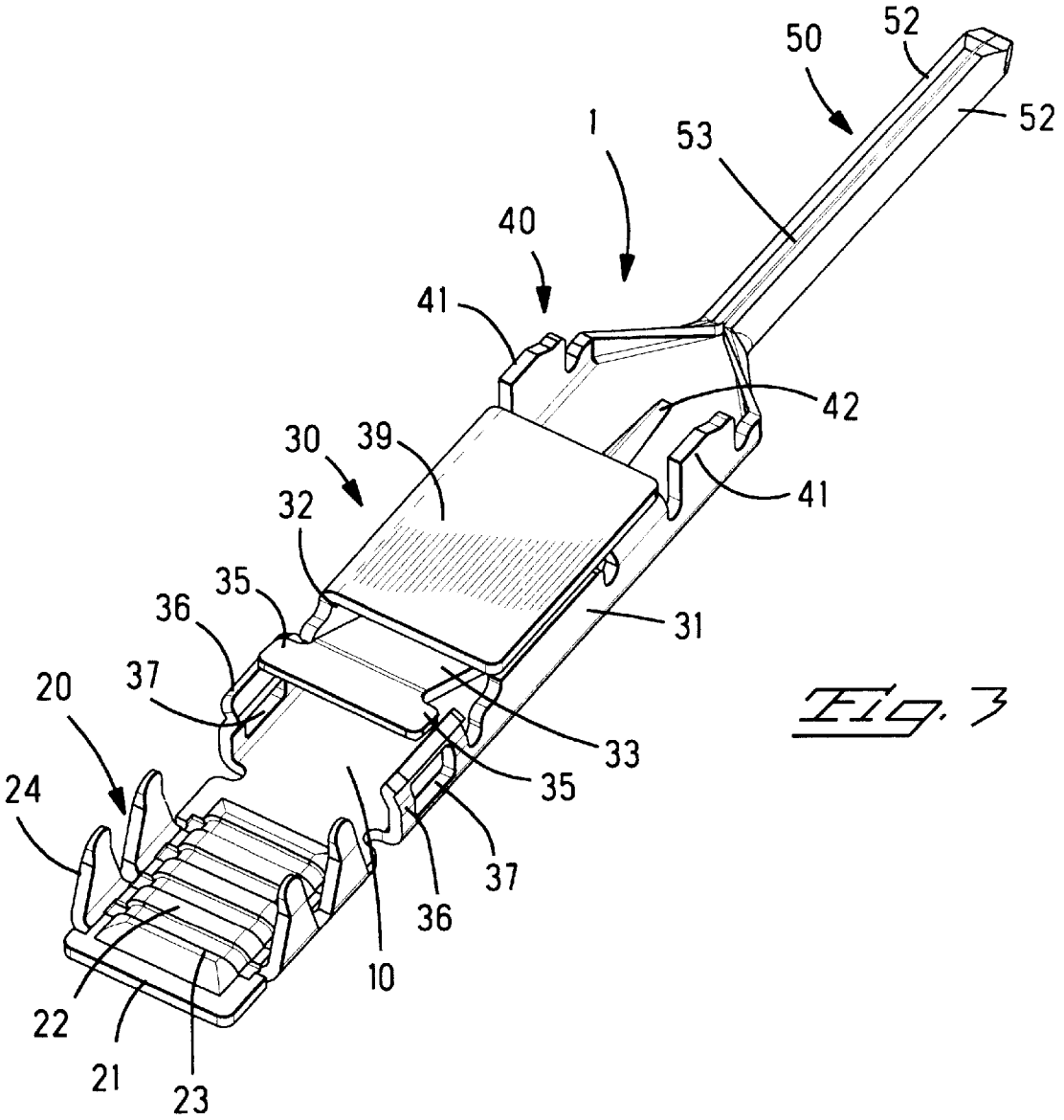
FIGS. 3 to 6 are isometric, elevation, top and bottom views of an electrical contact of FIGS. 1 and 2.

When the conductive member 60 is pressed by the embossment 34, anchoring parts 35,35 that protrude from both sides of the rear end of spring arm 33 are inserted into openings 37, and anchoring parts 35,35 contact the upper walls of openings 37,37 so that the upward movement of the spring arm 33 is checked. As a result, the pressing state of the embossment 34 of the spring arm 33 is maintained. Furthermore, a protective part 39 that protects the top of spring arm 33 is formed by being bent inward from the side wall 32 on the opposite side of the elastic contact part 30 from the side wall 31 from which spring arm 33 is bent. In FIG. 2, a stopper 43 checks the forward movement of the conductive member 60; stopper 43 is formed by being punched from the contact base 10 from below.

The housing fastening section 40 has a pair of press fitting walls 41,41 that are caused to rise from both sides of the front end of contact base 10, and a lance 42 that protrudes downward from the contact base 10 between the press fitting walls 41,41.

The mating terminal contact part 50 consists of a lower contact plate 51 that extends from the front end of the contact base 10, and a pair of upper contact plates 52,52 that are bent from both sides of the lower contact plate 51, and that are joined at a seam 53. The mating terminal contact part 50 has a tab shape in which the undersurface of the lower contact plate 51 and the upper surfaces of the upper contact plates 52 are parallel; the mating terminal (not shown) makes contact via the undersurface of the lower contact plate 51 and the upper surfaces of the upper contact plates 52.

Conductive member 60 is constructed by bonding a foil-form conductive part 62 to one or both sides of a flat insulating body 61 via a silver paste. In the present working configuration, the conductive part 62 is made of carbon, and is disposed on one side of the flat insulating body 61 as shown in FIG. 2. Insertion tabs 63 that are inserted into the terminating sections 20 of respective electrical contacts 1 are formed on one end of the conductive member 60; the lateral width of each of these insertion tabs 63 is approximately equal to the space between crimping arms 24,24 that rise from both sides of base section 21 of the corresponding electrical contact 1.

In order to terminate the conductive member 60 in the electrical contacts 1, and in order to cause elastic contact with the elastic contact parts 30 of electrical contacts 1, the insertion tabs 63 of the conductive member 60 are inserted between the crimping arms 24,24 of the terminating sections 20 of respective electrical contacts 1; then, with the tips of the insertion tabs 63 contacting the stopper parts 43 of the electrical contacts 1 as shown in FIG. 2, the crimping arms 24,24 are bent and crimped, and the spring arms 33 of the electrical contacts 1 are pressed so that the anchoring parts 35,35 that protrude from both sides of the rear end of each spring arm 33 are inserted into the openings 37,37 formed in the latching walls 36,36. As a result, the insertion tabs 63 of the conductive member 60 are terminated in the terminating sections 20 of the electrical contacts; furthermore, the insulating body side of the conductive member 60 is pressed by the embossments 34 of the spring arms 33 of the respective electrical contacts 1 so that the conductive part 62 of the conductive member 60 is caused to contact the rims of the substantially circular holes 38 in a substantially circumferential contact state. Thus, in the present working configuration, the conductive member 60 is terminated in the electrical contacts 1, and the elastic contact parts 30 of the electrical contacts 1 make spring biased contact with the conductive member 60, so that the connection of the electrical contacts 1 with the conductive member 60 is stable. In the elastic contact of the elastic contact parts 30 with the conductive member 60, the conductive part 62 of the conductive member 60 is caused to contact the rims of the substantially circular holes 38 in a substantially circumferential contact state. Accordingly, the contact area is greater than the contact area in cases where the conductive part 62 is in point-form or line-form contact. As a result, there is no concentration of heat in the contact areas, so that the danger of heat generation can be avoided.

What is claimed is:

1. An electrical contact comprising:

a terminating section that terminates a flat conductive member formed by disposing a foil-form conductive part on at least one side of a flat insulating body;

an elastic contact part that elastically contacts said conductive member and has a spring arm that has an embossment with a rounded surface that presses against the conductive member; and a base that has a substantially circular hole that faces the embossment of the spring arm, and that has a rim about said hole that is contacted in a substantially circumferential state of contact by the conductive part of the conductive member pressed by the embossment, said spring arm extending to a free end and being moveable between a first position and a second position such that, when in the first position, insertion of said conductive member into the electrical contact is permitted, and when in the second position said conductive member is pressed by the embossment, thereby forcing the conductive part against said rim of said circular hole, with anchoring sections of said spring arm free end becoming locked with latching arms of the base.

2. The electrical contact as set forth in claim 1, wherein said contact includes a tab shaped contact part at one end and said terminating section at an opposed end.

3. The electrical contact as set forth in claim 1, wherein said terminating section includes at least one pair of arms adapted to be crimped over a portion of said conductive member.

4. The electrical contact as set forth in claim 1, wherein said base of said contact includes a stopper that checks forward movement of said conductive member.

5. The electrical contact as set forth in claim 1, wherein said base of said contact includes a pair of opposed side walls, and said spring arm is joined to one of said side walls and is bent inward therefrom to extend between and along said side walls to said free end.

6. The electrical contact as set forth in claim 5, wherein the other of said side walls includes a protective part extending across a top of said spring arm.

7. The electrical contact as set forth in claim 1, wherein the anchoring sections extend laterally from edges of the spring arm free end.

8. The electrical contact as set forth in claim 7, wherein the latching arms have openings which receive the anchoring sections when the spring arm is in the second position.

9. An electrical contact comprising:

a terminating section that terminates a flat conductive member having a conductive surface opposite an insulating surface;

an elastic contact part having a spring arm with an embossment that contacts the insulating surface; and a base having an opening with a peripheral rim, wherein the embossment is disposed opposite the opening, the conductive surface being positionable on said base and over the opening, the spring arm extending to a free end and being moveable between a first position and a second position such that, when in the first position, insertion of the conductive member into the electrical contact is permitted, and when in the second position, the insulating surface is contacted by the embossment, thereby pressing the conductive surface against the rim of the opening.

10. The electrical contact as set forth in claim 9, wherein the spring arm free end has anchoring sections that become locked with latching arms of the base upon movement of the spring arm into the second position.

11. The electrical contact as set forth in claim 9, wherein the contact includes a tab shaped contact part at one end and the terminating section at an opposed end.

12. The electrical contact as set forth in claim 9, wherein the terminating section includes at least one pair of arms adapted to be crimped over a portion of the conductive member.

13. The electrical contact as set forth in claim 9, wherein the base of the contact includes a stopper that checks forward movement of the conductive member.

14. The electrical contact as set forth in claim 9, wherein the base of the contact includes a pair of opposed side walls, and the spring arm is joined to one of the side walls and is bent inwardly therefrom to extend between and along the side walls to the free end.

15. The electrical contact as set forth in claim 14, wherein the other of the side walls includes a protective part extending across a top of the spring arm.

* * * * *